US006209167B1

(12) United States Patent
Rooney et al.

(10) Patent No.: US 6,209,167 B1
(45) Date of Patent: Apr. 3, 2001

(54) HOVER VACUUM CLEANER

(75) Inventors: Michael Joseph Rooney, Hamilton; Michael Tony Mailes, Orillia, both of (CA)

(73) Assignee: Michael J. Rooney, Ontario (CA)

( * ) Notice: Subject to any disclaimer, the term of this patent is extended or adjusted under 35 U.S.C. 154(b) by 0 days.

(21) Appl. No.: 09/195,331

(22) Filed: Nov. 18, 1998

(30) Foreign Application Priority Data

Sep. 18, 1998 (CA) ..... 2 247 721

(51) Int. Cl.[7] ..... A47L 7/06
(52) U.S. Cl. ..... 15/327.3; 15/327.1; 15/353
(58) Field of Search ..... 15/327.1, 327.2, 15/327.3, 327.7, 353

(56) References Cited

U.S. PATENT DOCUMENTS 2,743,787 * 5/1956 Saek ..... 15/327.3
2,780,826 * 2/1957 Coons et al. ..... 15/327.3
3,958,299 * 5/1976 Tschudy ..... 15/327.3
5,799,363 * 9/1998 Inoue et al. ..... 15/327.3
5,799,745 * 7/1998 Kilstrom ..... 15/353
5,935,279 * 8/1999 Kilstrom ..... 15/353

FOREIGN PATENT DOCUMENTS

2945176 U * 5/1981 (DE) .

* cited by examiner

*Primary Examiner*—Terrence R. Till
(74) *Attorney, Agent, or Firm*—Dinsmore & Shohl LLP

(57) ABSTRACT

A hover vacuum cleaner has a casing, an underside to the casing, an impeller and drive motor for the impeller, a dust filter, an inlet for dust laden air, an exhaust port in the, a pathway for air to pass from the inlet, through the dust filter and impeller and around the motor, and through the exhaust port. The underside has dished air chambers, covering a substantial area of the underside. Preferably, the underside has at least two dished air chambers, each of which straddles the longitudinal axis of the underside. Adjacent dished air chambers are separated by a dam which is transverse to the longitudinal axis. The exhaust port is in direct fluid communication with one of the dished air chambers and the exhaust port also straddles the longitudinal axis. The underside has a peripheral groove which is in fluid communication with the exhaust port and/or the adjacent air chamber.

28 Claims, 3 Drawing Sheets

HOVER VACUUM CLEANER

FIELD OF THE INVENTION

The present invention relates to vacuum cleaners, and more particularly to air-supported hover vacuum cleaners.

BACKGROUND TO THE INVENTION

Air-supported vacuum cleaners are known. For example, U.S. Pat. No. 2,751,038 to L. K. Acheson, which issued Jun. 19, 1956 discloses an air-supported vacuum cleaner which has an air space on the underside of the cleaner, which is bounded by the underside of the casing for the cleaner and a peripheral dam or bead. Other air-supported vacuum cleaners are shown in U.S. Pat. No. 2,780,826 to Coons et al., which issued Feb. 12, 1957, U.S. Pat. No. 3,283,355 to I. Jepson, which issued Nov. 8, 1966 and U.S. Pat. No. 2,889,570 to J. E. Duff, which issued Jun. 9, 1959. U.S. Pat. No. 2,743,787 to W. G. Seck, which issued May 1, 1956 discloses an air-supported vacuum cleaner which has an air space bounded by the underside of the casing for the cleaner and a peripheral dam. Outside the peripheral dam there is a deflector for preventing air from discharging across the surface of the floor upon which the vacuum cleaner rests or travels, and for directing the escaping air in an upward direction.

One of the problems with previous air-supported vacuum cleaners is a tendency for the vacuum cleaner to rock or judder as a result of uneven flow of air escaping from under the peripheral dam. One solution to this problem is disclosed in U.S. Pat. No. 2,814,064 to J. C. Montgomery, which issued Nov. 26, 1957 which discloses an air-supported vacuum cleaner with a peripheral double dam with an air diffusing channel between the dams. The air escapes from the air space, past the inner of the two dams and thence through the air diffusing channel. Such an arrangement adds to the cost of the vacuum cleaner and introduces complexity to the operation of the vacuum cleaner. The present invention is directed to a simple but effective air-supported vacuum cleaner which tends to be stable, not subject to juddering and is relatively inexpensive to produce. The invention is also directed to a hover vacuum cleaner with an arrangement which the hover performance tends not to diminish as the filter becomes filled with dust.

SUMMARY OF THE INVENTION

The present invention provides a vacuum cleaner comprising:

a casing, an underside to the casing in which the underside has a longitudinal axis, an impeller and drive motor for the impeller, a dust filter, an inlet for dust laden air, an exhaust port in the, a pathway for air to pass from the inlet, through the dust filter and impeller and around the motor, and through the exhaust port;

wherein the underside has dished air chambers, covering a substantial area of the underside, in locations selected from the group consisting of i) at least two dished air chambers on the underside, wherein each dished air chamber straddles the longitudinal axis, and adjacent dished air chambers are separated by a dam which is transverse to the longitudinal axis, and wherein the exhaust port is in direct fluid communication with one of the dished air chambers and the exhaust port straddles the longitudinal axis, ii) a first dished air chamber which straddles the longitudinal axis and an exhaust port which straddles the longitudinal axis, wherein the exhaust port is in direct fluid communication with the first air chamber, and at least one pair of dished air chambers wherein corresponding dished air chambers in each pair are on opposing sides of the longitudinal axis separated by a keel skirt, and wherein the first air chamber and the adjacent pair of dished air chambers are separated by a dam which is transverse to the longitudinal axis, and wherein the adjacent pairs of dished air chambers are separated by a dam which is transverse to the longitudinal axis; and wherein the underside has a peripheral groove which is in fluid communication with a member selected from the group consisting of the exhaust port and the air chamber which is in direct fluid communication with the exhaust port, and a combination thereof.

In one embodiment, there are three dished air chambers, each of which straddle the longitudinal axis.

In a further embodiment, there are three dished air chambers, each of which straddles the longitudinal axis, and the air chamber in fluid communication with the exhaust port is an outer chamber.

In another embodiment, the underside of the vacuum has an extension which extends outwardly and upwardly from the peripheral groove, with the extension having an arcuate cross-section.

In yet another embodiment, the vacuum cleaner has a cyclonic action dust filter.

In a further embodiment, the inlet for dust laden air, which leads to the cyclonic action dust filter, has a nozzle which is rotatable about an axis which is parallel to a longitudinal axis for the dust filter.

In another embodiment, the inlet for dust laden air, which leads to the cyclonic action dust filter, has a nozzle which is rotatable so that the nozzle may direct air at any downward angle into the dust filter.

In yet another embodiment, the pathway for air from the impeller to the exhaust port is constrained by walls so that there is a steady flow of air therethrough when the vacuum is in operation.

In another embodiment, the walls are in a partial snail shell shape.

The present invention also provides a hover vacuum cleaner comprising:

a casing, an underside to the casing, a cyclonic dust filter, hover means on the underside to allow the vacuum cleaner to hover on a bed of air, an inlet to the cyclonic dust filter for dust laden air, an impeller and drive motor for the impeller, an exhaust port in the underside, a pathway for air to pass from the inlet, through the dust filter and impeller and around the motor, and through the exhaust port to the hover means.

In one embodiment, the inlet for dust laden air, which leads to the cyclonic action dust filter, has a nozzle which is rotatable about an axis which is parallel to a longitudinal axis for the dust filter.

In another embodiment, the inlet for dust laden air, which leads to the cyclonic action dust filter, has a nozzle which is rotatable so that the nozzle may direct air at any downward angle into the dust filter.

In yet another embodiment, the pathway for air from the impeller to the exhaust port is constrained by walls so that there is a steady flow of air therethrough when the vacuum is in operation.

DETAILED DESCRIPTION OF PREFERRED EMBODIMENTS

Figure 1:
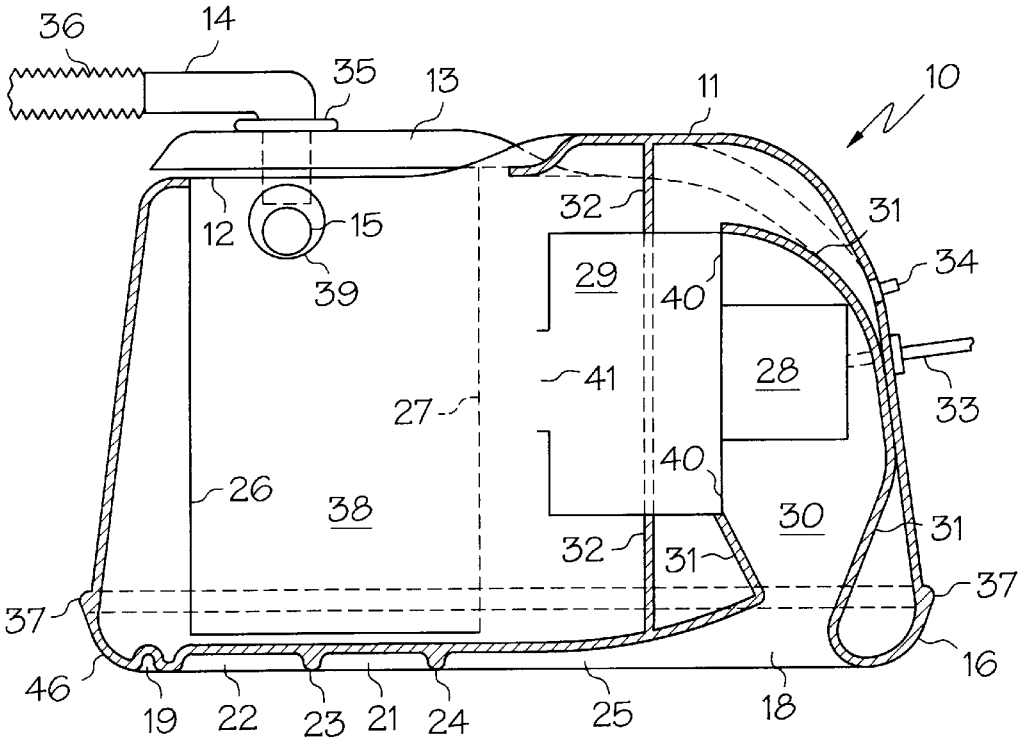
FIG. 1 is a cross-sectional side view of a vacuum cleaner of the present invention.

The drawings show a vacuum cleaner 10 which has an upper body casing 11 and a lower body casing 16 joined at joint 37. Upper body casing 11 has an upper opening 12. Opening 12 is for removing and replacing a filter within filter cavity 38. Opening 12 is closed with lid 13. Suction inlet tube 14 is connected to lid 13 by swivel bearing 35. Suction inlet tube 14 leads through lid 13 into filter cavity 38 and terminates in opening 15 in nozzle 39.

Figure 2:
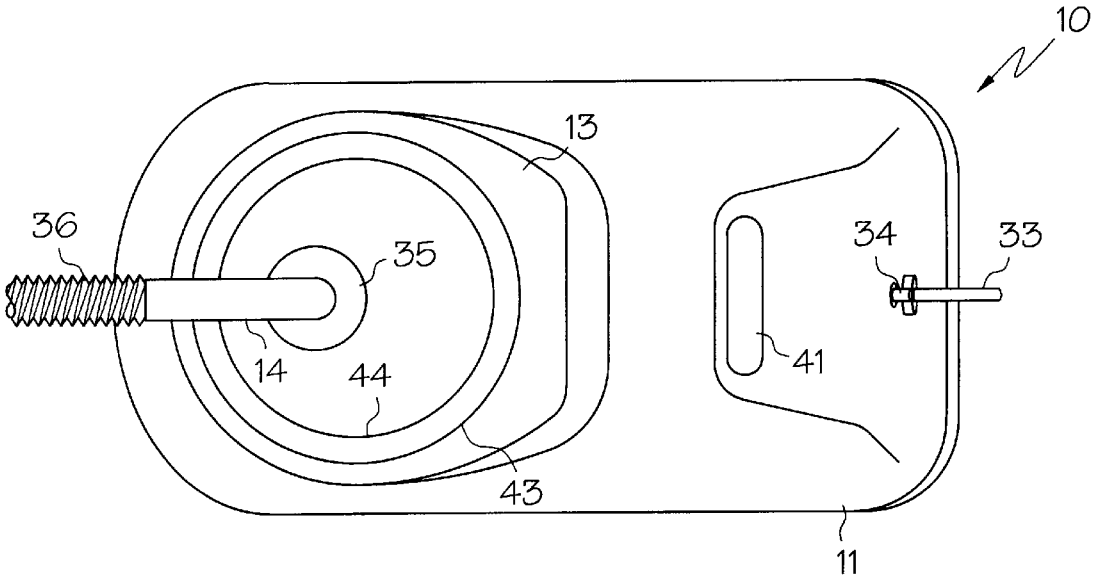
FIG. 2 is a top view of the vacuum cleaner of FIG. 1.

Located inside vacuum cleaner 10 is filter cavity 38 which is bounded by a filter container 43 (see FIG. 2), which comprises front wall 26 and rear perforated wall 27 (see FIG. 1). A filter bag 44 may be inserted into filter cavity, as is known in the art. Also located in upper body casing 11 is motor 28 and impeller 29. Impeller 29 is positioned within vacuum cleaner 10 by means of wall 32, which also serves to ensure that air is drawn by impeller 29 from the filter 44. Impeller 29 has inlet apertures 41 and outlet apertures 40. Outlet apertures lead into chamber 30 which surrounds motor 28. As shown in FIG. 1, chamber 30 is bounded by chamber walls 31. Chamber walls 31 allow for direction of a steady flow of air from outlets 40, past motor 28, to exhaust port 18 in the bottom of lower casing 16. The chamber walls 31 are preferably in the shape of a partial snail shell, as shown in FIG. 1. Chamber walls 31 avoid deadspots of air flow as in prior designs, in which air enters a large chamber before exiting through exhaust port 18. The inlet 14 is connected to flexible tube 36, which is connected to a power head (not shown), or other dust receiving tools as is known in the art.

Motor 28 is an electric motor and is electrically powered through electric cord 33, which enters upper body casing 11 through a hole at the rear of the vacuum. Electric motor 28 is controlled by on-off switch 34. The top of body casing 11 has a handle 42.

The underside 17 of lower body casing 16 has three dished air chambers 21, 22 and 25, each of which is symmetrical about, and straddles, longitudinal axis X—X. Air chamber 25 has exhaust port 18 therein. Air chambers 25 and 21 are separated by transverse bar 24. Air chambers 22 and 21 are separated by transverse bar 23. Around the periphery of underside 17 there is a channel 19 which connects with air chamber 25 by connecting passage 20. In the embodiment shown, there is an arcuately shaped extension 46 which curves upwardly to the main part of casing 11. While this is not essential, it has been found to be beneficial in helping the stability of the vacuum cleaner.

The placement of the dished air chambers 21, 22 and 25 need not be symmetrical about the longitudinal axis. Indeed, it has been found that at least one of the air chambers by be offset from the longitudinal axis, so that portion of the air chamber on one side of the longitudinal axis is larger than the portion on the opposing side of the longitudinal axis. The reason for this is not known, but in some instances it has been demonstrated to be beneficial.

It is preferable that the ratio of the total area of the dished air chambers to the total area of the underside be at least about 70:100 and preferably from about 75:100 to 95:100.

Figure 4:
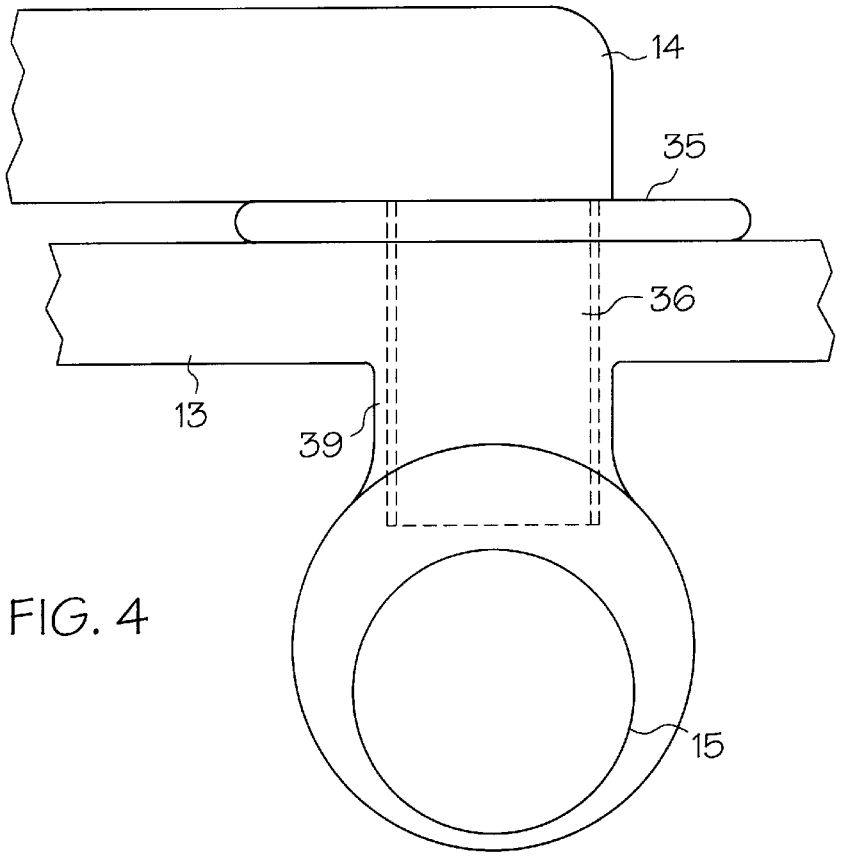
FIG. 4 is a view showing the lid, inlet tube and the mouth of an inlet nozzle, also shown in FIG. 1.

The inlet tube 14 is connected to lid 13 at a swivel bearing 35, as shown in FIG. 4. Inlet tube is in fluid connection with inlet nozzle 39. Inlet nozzle 39 has an opening 15 through which dust laden air may be directed at an angle into filter cavity 38. In the embodiment shown, inlet nozzle 39 may be swivelled in a 360° arc so that opening 15 may be directed towards any part of the upright wall of filter container 43, e.g. rear wall 27 or front wall 26. Preferably, the filter arrangement is a so-called cyclonic filter. Cyclonic filters are known and have previously been used in conventional vacuum cleaners with wheels.

In operation, when the motor 28 is energized, air is drawn through the vacuum cleaner by means of the impeller 29, which is driven by motor 28. Dust laden air is picked up by a power head or other tool (not shown) and is sucked into filter cavity 38 through flexible tube 36, inlet tube 14 and nozzle 39. Nozzle 39 directs the dust laden air into filter cavity 38 as indicated schematically by arrows A and B in FIG. 5. Cyclonic action of the air permits the dust to drop out of the air flow, before being drawn through filter 44, and into impeller 29 through passageway 41. Air is then expelled by impeller 29 past motor 28 and into chamber 30. In the embodiments shown in the drawings, the chamber 30 is bounded by walls 31, which direct the filtered air past the motor housing and to exhaust port 18. The walls 31 are not essential but have the benefits of preventing stagnation of air in chamber 30, keeping a high airflow over the motor housing and thus keeping the motor cooler than would otherwise be the case. Without walls 31, air tends to be compressed in chamber 30 and the air flow patterns are such that there is a heat build up in chamber 30.

With respect to the dust laden air entering the filter cavity 38, the flow of the air can be controlled by the angles of entry of the air through opening 15, relative to directions parallel and transverse to the longitudinal axis Y—Y (see FIG. 5) of the filter cavity 38, and the offset of the opening 15 from the longitudinal axis Y—Y. The angle of air flow and positioning of inlet nozzle 39 will affect the air flow pattern, and thus the cyclonic action, in filter cavity 38. The cyclonic action tends to keep the walls of the filter bag 44 from being clogged. As will be appreciated, clogging of the walls of filter bag 44 would lead to a pressure drop and consequent lowering of the rate of air flow into the impeller. A particular advantage of the cyclonic air filter for a hover vacuum is that there is little lessening of air flow through the filter as the bag becomes filled with dust. Accordingly, the hover action of the vacuum cleaner tends not to be impaired as the filter becomes filled with dust. The cyclonic action of the filter improves the performance of hover vacuum cleaners with hover systems which are not shown in the drawings. For example, a cyclonic filter will improve the performance of hover vacuum cleaners as disclosed in the aforementioned U.S. Pat. No. 2,780,826 to Coons et al., U.S. Pat. No. 3,283,355 to I. Jepson and U.S. Pat. No. 2,889,570 to J. E. Duff, among others.

Although the drawings show the vacuum cleaner 10 as having a cyclonic action filter system, such a system is not necessary for the operation of one aspect of the invention. It is, however, especially preferred.

The hover action of the vacuum cleaner 10 is effected by air flow from exhaust port 18 across the underside 17, before escaping from the periphery of the underside 17. Without wishing to be held to any theory, Applicant believes that the peripheral channel 19 allows air to be directed in a peripheral "skirt", while the dished air chambers 21 and 22 provide compression pockets at the forward end of the vacuum 10. Without the peripheral channel, there is a tendency for the vacuum cleaner to judder and become unstable. The positioning of dams 23 and 24 between adjacent air chambers is critical to the hovering action of the vacuum cleaner. For example, it has been found that displacement of dam 23 by as little as 3–4 cm along the longitudinal axis X—X is sufficient to alter the air flow patterns so that the vacuum cleaner no longer hovers. Notwithstanding the criticality of the positioning, however, the correct positions for the dams can be found by simple experimentation.

Figure 3:
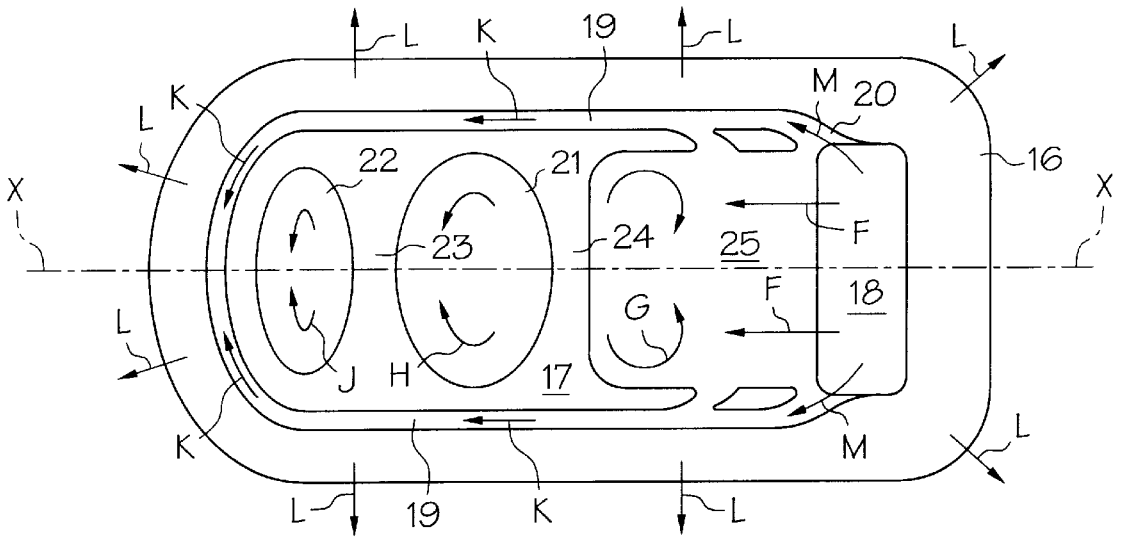
FIG. 3 is a bottom view of the vacuum cleaner of FIG. 1.
Figure 5:
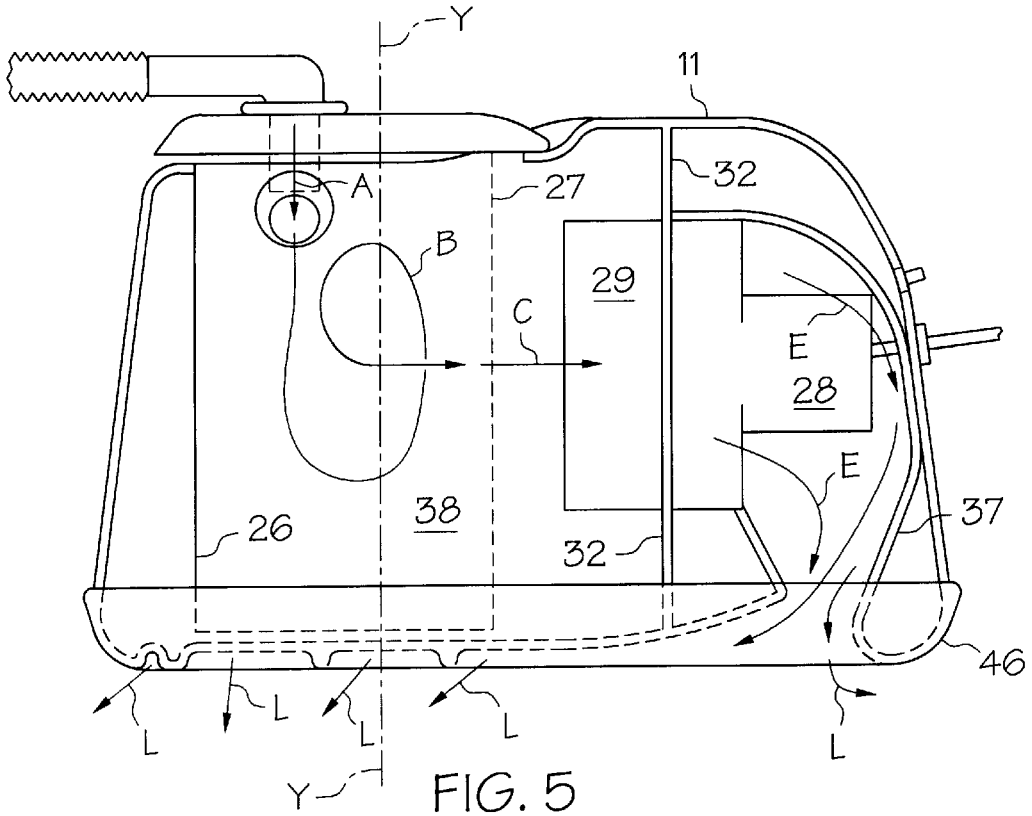
FIG. 5 is a cross-sectional side view of the vacuum cleaner of FIG. 1, showing air flows.

The air flow patterns are shown schematically in FIGS. 3 and 5. Dust laden air flows through nozzle 39 as indicated by arrow A, before being directed in a vortex pattern B in filter cavity 38. The air then passes through filter bag 44 and into impeller 29 as indicated by arrow C. The impeller then forces the air into air chamber 30 in the direction shown by arrow E and thence through exhaust port 18, as shown by arrow D. After exiting through exhaust port 18, some of the air is directed into channel 19 as shown by arrows M and K. Some of the air is also directed into dished air chamber 25 as shown by arrows F. The air swirls in chamber 25 as shown by arrows G. Some of this air spills over dams 24 and 23 and swirls in air chambers 21 and 22 as shown by arrows H and J respectively. The air then escapes from the underside 17 as indicated by arrows L. It will be recognized that the patterns shown may not be true representations of the air flow.

It has been found that, apart from the dished air chambers 21, 22 and 25, channel 19 and the periphery of the underside, the remainder of the underside is preferably flat.

Figure 6:
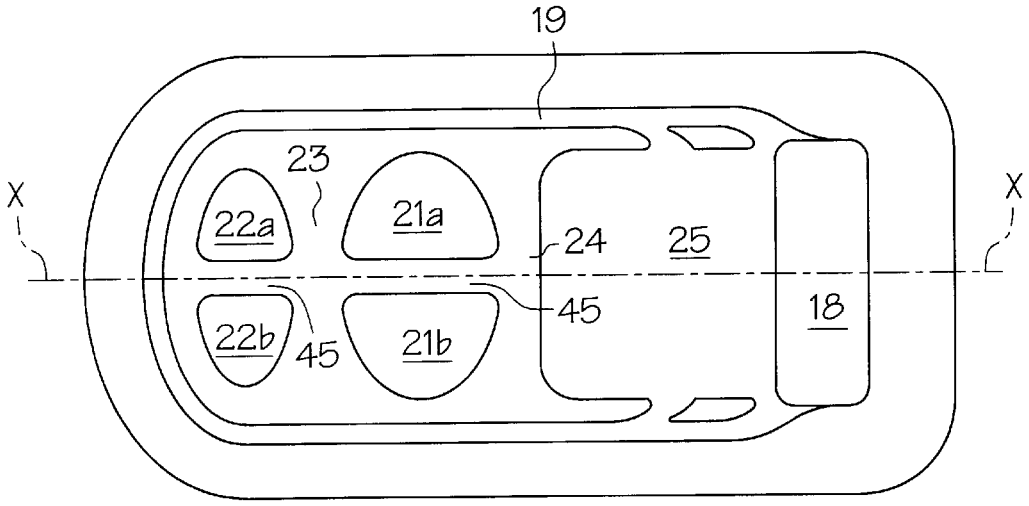
FIG. 6 is a bottom view of another embodiment of a vacuum cleaner.

Another arrangement of dished air chambers on the underside of the vacuum cleaner may be as shown in FIG. 6. As will be apparent, the difference between the underside of FIGS. 3 and 6 lies in the longitudinal division of dished air chambers 21 and 22 of FIG. 3 by a keel skirt. In FIG. 6, the keel skirt 45 separates dished air chambers 21*a* and 21*b*, and 22*a* and 22*b*. Other combinations of dished air chambers, dams and keel skirts are operable and these may be determined through simple experimentation. For example, there may only be one pair of dished air chambers 21*a* and 21*b* on opposing sides of longitudinal axis X—X.

The vacuum cleaner may be made using conventional materials. For example the casing, impeller walls and inlet tubing may be made from synthetic thermosetting or thermoplastic polymers, glass fibre reinforced plastic (FRP), metal or other suitable materials.

The vacuum cleaner may also have other features. For example, the electric cord 33 may be automatically retractable into the housing using a spring loaded reel. The filter housing may also have facility for inserting a pouch with fragrant material therein.

The vacuum cleaner of the present invention may be used on many types of floor surface, including carpeted surfaces. The vacuum works well on stairs also, as long as the whole of underside 17 remains on a stair step. If the vacuum cleaner works its way to an edge of the stair step sufficient for part of channel 19 to be unsupported by the stair, then air will be caused to spill at the unsupported part and thus cause the vacuum cleaner to lose its hovering action. In this way there is less likelihood of the vacuum cleaner from being dislodged from the stair than for conventional wheeled vacuum cleaners.

EXAMPLE

A hover vacuum cleaner was constructed substantially to the shape and design shown in FIGS. 3 and 5. The length direction given hereinafter is in the direction of longitudinal axis X—X and the width is transverse to the length. The exhaust port had a length of 3.8 cm and a width of 10.2 cm. Dished air chamber 25, which emanated from exhaust port 18 had a length of 15.2 cm, a width of 11.4 cm and a depth of 0.5 cm. Dished air chamber 21 had a length of 3.8 cm, a width of 11.4 cm. and a depth of about 0.65 cm. Dished air chamber 22 had a length of 5.1 cm, a width of about 11.4 cm and a depth of about 0.65 cm. Exhaust port 18 and dished air chambers 25 and 21 were centred about longitudinal axis X—X and dished air chamber 22 was offset by about 0.95 cm. Dams 23 and 24 were about 0.95 cm between adjacent dished air chambers and the edges of dams 23 and 24 sloped into the adjacent dished air chambers to provide for smooth air flow over the dams. The ratio of the total area of the dished air chambers to the area of the underside was about 80:100.

In operation, the vacuum cleaner moved smoothly over carpeted and tiled floors while dust was being vacuumed from the floors.

What is claimed is:

1. A vacuum cleaner comprising:

a casing, an underside to the casing in which the underside has a longitudinal axis, an impeller and drive motor for the impeller, a dust filter, an inlet for dust laden air, an exhaust port in the underside to the casing, a pathway for air to pass from the inlet, through the dust filter and impeller and around the motor, and through the exhaust port;

wherein the underside has dished air chambers, covering a substantial area of the underside, in locations selected from the group consisting of i) at least two dished air chambers on the underside, wherein each dished air chamber straddles the longitudinal axis, and adjacent dished air chambers are separated by a dam which is transverse to the longitudinal axis, and wherein the exhaust port is in direct fluid communication with one of the dished air chambers and the exhaust port straddles the longitudinal axis, ii) a first dished air chamber which straddles the longitudinal axis and an exhaust port which straddles the longitudinal axis, wherein the exhaust port is in direct fluid communication with the first air chamber, and at least one pair of dished air chambers wherein corresponding dished air chambers in each pair are on opposing sides of the longitudinal axis separated by a keel skirt, and wherein the first air chamber and the adjacent pair of dished air chambers are separated by a dam which is transverse to the longitudinal axis, and wherein the adjacent pairs of dished air chambers are separated by a dam which is transverse to the longitudinal axis; and wherein the underside has a peripheral groove which is in fluid communication with a member selected from the group consisting of the exhaust port and the air chamber which is in direct fluid communication with the exhaust port, and a combination thereof.

2. A vacuum cleaner according to claim 1 wherein there are three dished air chambers, each of which straddle the longitudinal axis.

3. A vacuum cleaner according to claim 2 wherein the vacuum cleaner has a cyclonic action dust filter.

4. A vacuum cleaner according to claim 3 wherein the inlet for dust laden air, which leads to the cyclonic action dust filter, has a nozzle which is rotatable about an axis which is parallel to a longitudinal axis for the dust filter.

5. A vacuum cleaner according to claim 3 wherein the inlet for dust laden air, which leads to the cyclonic action dust filter, has a nozzle which is rotatable so that the nozzle may direct air at any downward angle into the dust filter.

6. A vacuum cleaner according to claim 2 wherein the pathway for air from the impeller to the exhaust port is constrained by walls so that there is a steady flow of air therethrough when the vacuum is in operation.

7. A vacuum cleaner according to claim 2 wherein the air chamber in fluid communication with the exhaust port is an outer chamber.

8. A vacuum cleaner according to claim 7 wherein the underside of the vacuum has an extension which extends outwardly and upwardly from the peripheral groove, with the extension having an arcuate cross-section.

9. A vacuum cleaner according to claim 1 wherein the underside of the vacuum has an extension which extends outwardly and upwardly from the peripheral groove, with the extension having an arcuate cross-section.

10. A vacuum cleaner according to claim 1 wherein the vacuum cleaner has a cyclonic action dust filter.

11. A vacuum cleaner according to claim 10 wherein the inlet for dust laden air, which leads to the cyclonic action dust filter, has a nozzle which is rotatable about an axis which is parallel to a longitudinal axis for the dust filter.

12. A vacuum cleaner according to claim 10 wherein the inlet for dust laden air, which leads to the cyclonic action dust filter, has a nozzle which is rotatable so that the nozzle may direct air at any downward angle into the dust filter.

13. A vacuum cleaner according to claim 10 wherein the pathway for air from the impeller to the exhaust port is constrained by walls so that there is a steady flow of air therethrough when the vacuum is in operation.

14. A vacuum cleaner according to claim 1 wherein the pathway for air from the impeller to the exhaust port is constrained by walls so that there is a steady flow of air therethrough when the vacuum is in operation.

15. A vacuum cleaner according to claim 1 wherein:

i) there are three dished air chambers, each of which straddle the longitudinal axis;

ii) the air chamber in fluid communication with the exhaust port is an outer chamber;

iii) the underside of the vacuum has an extension which extends outwardly and upwardly from the peripheral groove, with the extension having an arcuate cross-section;

iv) the vacuum cleaner has a cyclonic action dust filter.

16. A hover vacuum cleaner comprising:

a casing, an underside to the casing, a cyclonic dust filter, hover means on the underside to allow the vacuum cleaner to hover on a bed of air, an inlet to the cyclonic dust filter for dust laden air, an impeller and drive motor for the impeller, an exhaust port in the underside, a pathway for air to pass from the inlet, through the dust filter and impeller and around the motor, and through the exhaust port to the hover means, wherein the inlet for dust laden air, which leads to the cyclonic action dust filter, has a nozzle which is rotatable about an axis which is parallel to a longitudinal axis for the dust filter.

17. A hover vacuum cleaner according to claim 16 wherein the inlet for dust laden air, which leads to the cyclonic action dust filter, has a nozzle which is rotatable so that the nozzle may direct air at any downward angle into the dust filter.

18. A hover vacuum cleaner according to claim 16 wherein the pathway for air from the impeller to the exhaust port is constrained by walls so that there is a steady flow of air therethrough when the vacuum is in operation.

19. A vacuum cleaner comprising:

a) a casing with an upper body portion and an underside to the casing in which the underside has a longitudinal axis and a lower base surface with an outer rim, the casing having an air inlet for dust laden air and an exhaust port in the base surface;

b) a drive motor with an air impeller located within the casing, the impeller communicating with the inlet and exhaust port through a pathway extending from the inlet to the exhaust port to permit air to flow along an airflow path within said pathway; and c) a dust filter positioned in the air flow path between the impeller and the air inlet, wherein the base surface is generally planar about a base plane and said base surface comprises a peripheral channel extending adjacent to the rim of the base surface, said channel generally circumscribing the inner portion of the base surface and extending to communicate with the exhaust port to receive air delivered from the impeller through the exhaust port outlet and provide air flotation lift to the vacuum cleaner when the base surface is placed over a level floor surface.

20. A vacuum cleaner according to claim 19 comprising a depression formed in the base surface to provide an air chamber within the region of the base surface contained collectively by the peripheral channel and exhaust port, whereby said air chamber will contain a volume of pressurized air received from the exhaust port and stabilize the base surface to maintain a horizontal relationship with a floor surface.

21. A vacuum cleaner according to claim 20 wherein the base surface has a longitudinal median line and said depression is bifurated along the longitudinal median line of the base surface by a portion of the base surface that forms a first dam to divide the air chamber into two portions.

22. A vacuum cleaner according to claim 21 wherein said two portions of the air chamber are respectively partitioned along a transverse line extending across the base surface perpendicularly to the longitudinal line by a portion of the base surface that forms a second dam to form two pairs of portions of the air chamber.

23. A vacuum cleaner according to claim 20 wherein the depression has a depth of 0.5 to 0.65 centimeters.

24. A vacuum cleaner according to claim 19 wherein the exhaust port is located at one end of the base surface and the air inlet is located on a part of the upper body portion of the casing, above the end of the base surface opposite to the exhaust port.

25. A vacuum cleaner according to claim 24 wherein the casing has two sides and two end faces, the motor is electrical and wherein the motor is provided with current through an electrical cord that enters the case through an end face that is located at the same end of the vacuum cleaner base surface as the exhaust port.

26. A vacuum cleaner according to claim 19 comprising a snail-shell-shaped conduit containing the air flow path between the impeller and the exhaust port, the conduit being shaped and dimensioned to deliver air along the air flow path without dead spots forming therein.

27. A vacuum cleaner according to claim 19 wherein the dust filter has an upper portion positioned in the air flow path and a lower portion positioned beneath the air flow path whereby air flow within the filter is stratified, high speed air flow occurring principally in the upper portion of the filter to permit dust to settle preferentially in the lower portion of the filter.

28. A vacuum cleaner according to claim 27 wherein the air flow within the dust receptacle is cyclonic.

* * * * *